US005111537A

United States Patent [19]

Zaruba

[11] Patent Number: 5,111,537

[45] Date of Patent: * May 12, 1992

[54] TOILET APPARATUS

[76] Inventor: Wenzel Zaruba, 20 Battleridge Trail, Totowa, N.J. 07512

[ * ] Notice: The portion of the term of this patent subsequent to Sep. 12, 2008 has been disclaimed.

[21] Appl. No.: 363,047

[22] Filed: Jun. 8, 1989

[51] Int. Cl.[5] ..... E03D 1/14; E03D 3/12

[52] U.S. Cl. ..... 4/324; 4/325; 4/326; 4/363; 4/364; 4/415

[58] Field of Search ..... 4/325-327, 4/415, 424, 363, 382, 364, 379, 381, 391

[56] References Cited

U.S. PATENT DOCUMENTS

| | | | |
|---|---|---|---|
| 1,132,608 | 3/1915 | Newland | 4/326 |
| 1,323,703 | 12/1919 | Linfoot | 4/325 |
| 1,805,204 | 5/1931 | Brown | 4/326 |
| 3,344,439 | 10/1967 | Davies | 4/363 X |
| 3,419,912 | 1/1969 | Kartell | 4/391 X |
| 3,820,170 | 6/1974 | Kern et al. | 4/415 |
| 3,903,550 | 9/1975 | Wilhelm | 4/326 |
| 3,946,447 | 3/1976 | Moon | 4/415 |
| 4,110,850 | 9/1978 | Tedei | 4/326 |
| 4,134,165 | 1/1979 | Phripp et al. | 4/379 X |
| 4,143,430 | 3/1979 | Joshi et al. | 4/415 X |
| 4,144,600 | 3/1979 | Mayes | 4/325 X |
| 4,225,985 | 10/1980 | Joshi et al. | 4/415 X |
| 4,388,737 | 6/1983 | Wenzel | 4/415 |
| 4,530,119 | 7/1985 | Chiu et al. | 4/325 |
| 4,748,699 | 6/1988 | Stevens | 4/381 X |
| 4,882,793 | 11/1989 | Thompson | 4/381 X |
| 4,907,302 | 3/1990 | Schoepe et al. | 4/379 X |

FOREIGN PATENT DOCUMENTS

| | | | |
|---|---|---|---|
| 2620151 | 3/1989 | France | 4/363 |

*Primary Examiner*—Henry K. Artis

*Attorney, Agent, or Firm*—Ribis, Graham & Curtin

[57] ABSTRACT

A toilet apparatus for use in conserving water is provided. The toilet apparatus includes a toilet tank for water, a conventional fluid supply valve, a low volume discharge valve, and a high volume discharge valve. A first embodiment has a housing having a portion extending through the bottom wall of the toilet tank. A high volume discharge valve is connected to the housing near its bottom end for nearly 100 percent fluid discharge. A low volume discharge valve is connected to the housing near its to end for about 40 percent volume fluid discharge. A handle subassembly having a handle and bent rod and chain for each discharge valve is included. Second, third and fourth embodiments include a toilet tank having an interior partition separating a first compartment from a second compartment. The partition has a gate opening with a gate door. A handle subassembly has a handle and rod and chain for a discharge valve located within the first compartment and has a second handle and rod and chain for the gate door in the partition wall. The high volume discharge occurs through the discharge valve with the gate door in a an open position. The low volume discharge occurs through the same discharge valve with the gate door in a closed position.

4 Claims, 7 Drawing Sheets

TOILET APPARATUS

The invention relates to a toilet apparatus, and in particular the invention relates to a toilet apparatus having a dual volume fluid discharge.

BACKGROUND OF THE INVENTION

The prior art toilet apparatus includes a toilet tank for holding water, an automatic water supply means, a single-volume water discharge means, and a manual operating means for operating the discharge means.

One problem with the prior art toilet apparatus is that conservation of water is difficult to achieve and with the major amounts of usage substantially less water is required.

SUMMARY OF INVENTION

According to the present invention, a toilet apparatus is provided. This apparatus comprises a toilet tank for holding water, an automatic water supply means, a first water discharge means, a second water discharge means, and manual operating means for operating the first discharge means and the second discharge means.

By using a second discharge means, a relatively low volume can be discharged, if desired, so conservation of water can be readily achieved.

The foregoing and other objects, features and the advantages of the invention will be apparent from the following description of the preferred embodiment of the invention as illustrated in the accompanying drawings.

Figure 13:
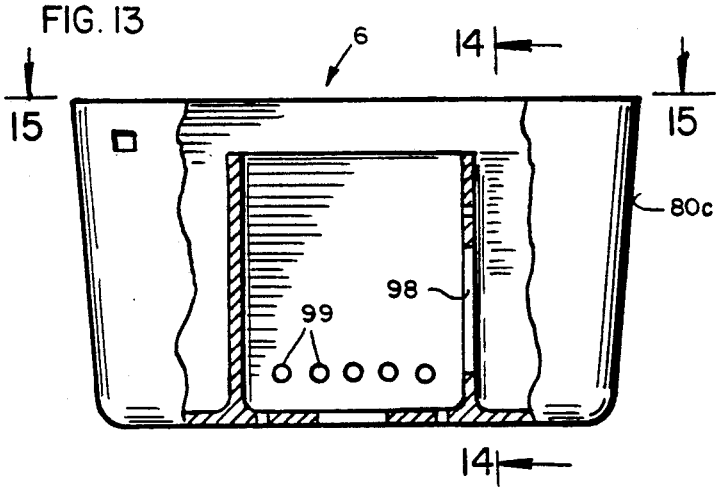
FIG. 13 is an elevation view which shows a third embodiment of the invention.
Figure 25:
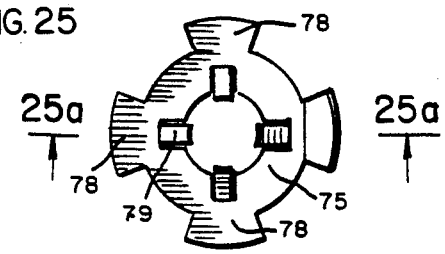
FIG. 25 is a plan view of the retaining ring as shown in FIG. 24.
Figure 25A:
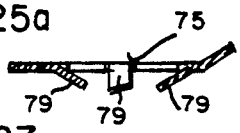
Figure 26:
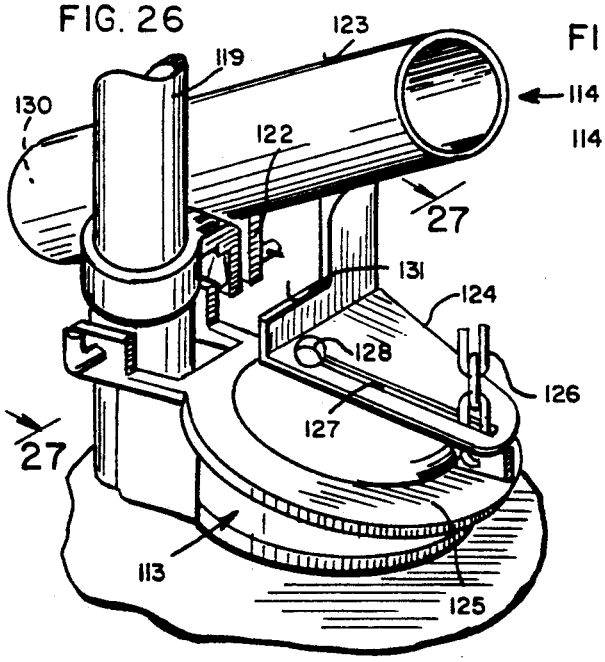
Figure 27:
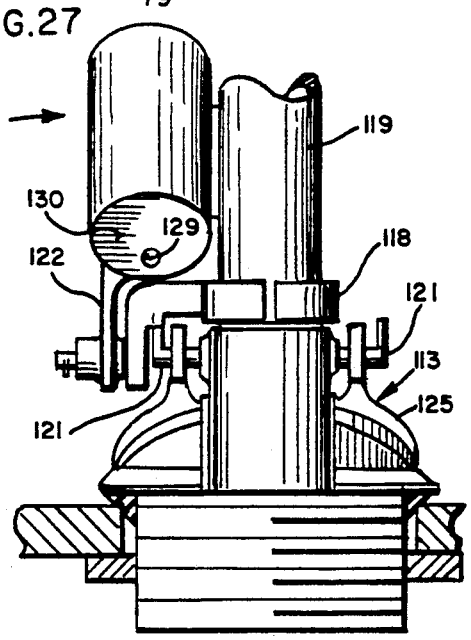
Figure 28:
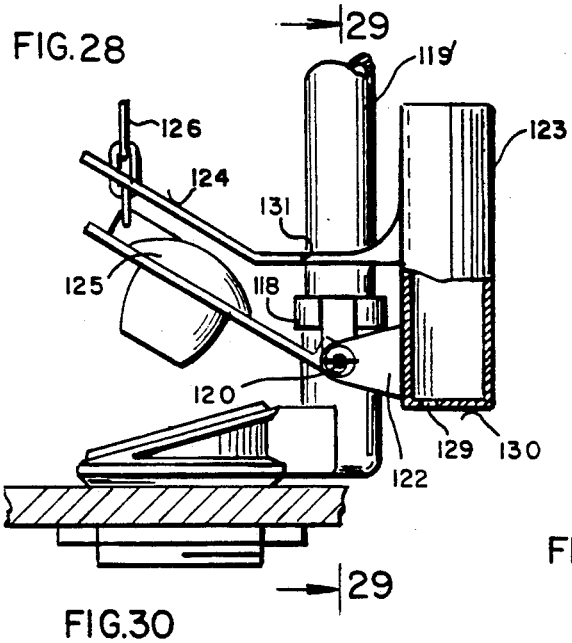
Figure 29:
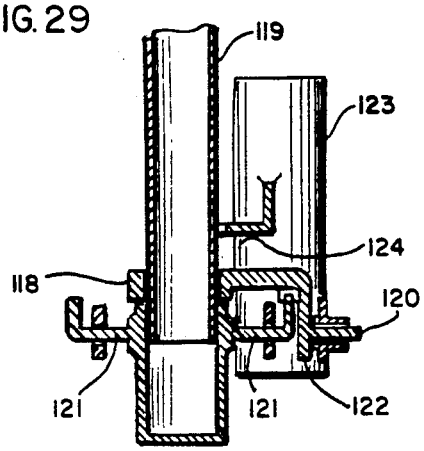
Figure 30:
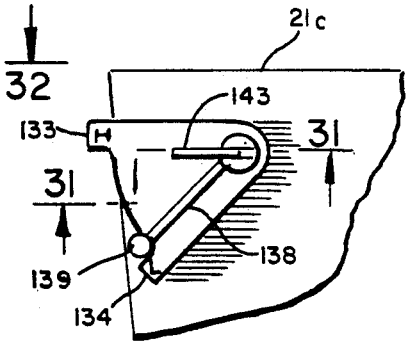

FIG. **25*a* is a section view as taken along line 25*a*—25*a* of FIG. 25**;

FIG. 26 is a perspective view of a flow timing device for the embodiment of FIG. 13;

FIG. 27 is a section view as taken along line 27—27 of FIG. 26;

FIG. 28 is a section view of the device of FIG. 26 in a different operating condition;

FIG. 29 is a section view as taken along line 29—29 of FIG. 28;

FIG. 30 is an elevation view of a handle subassembly for the embodiment of FIG. 13.

Figure 31:
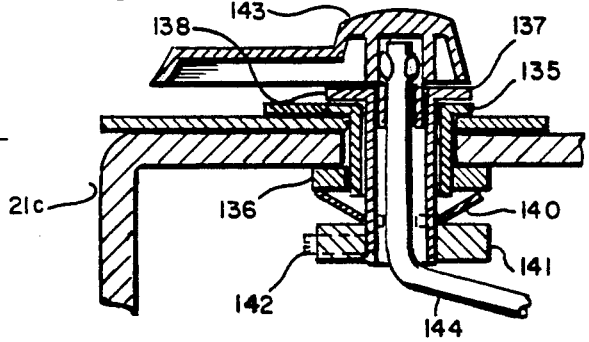
Figure 32:
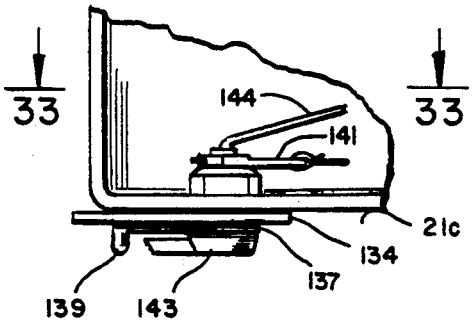
Figure 33:
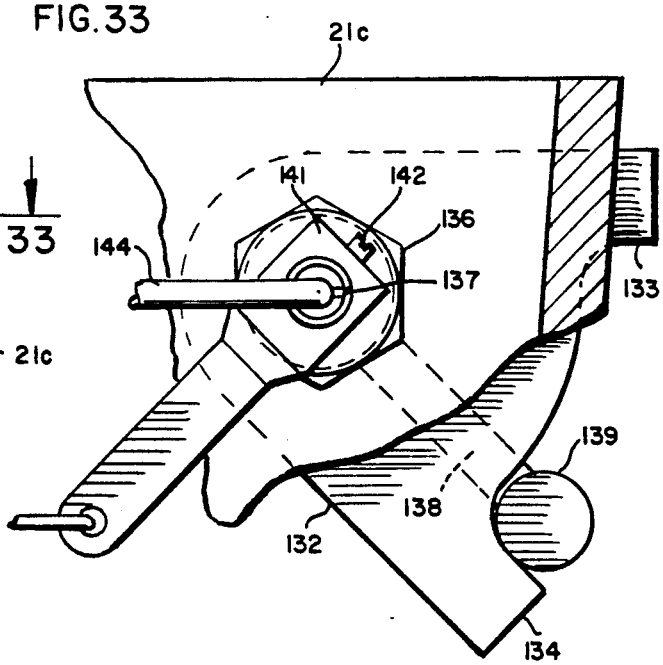
Figure 34:
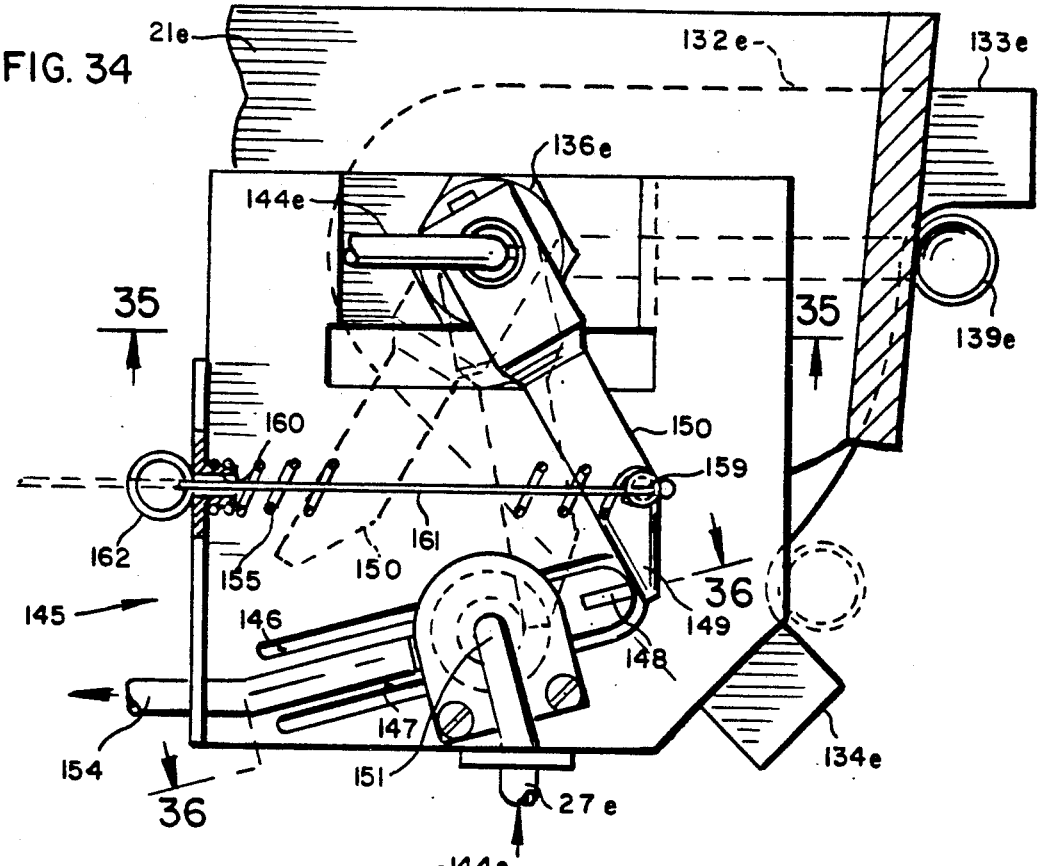
Figure 35:
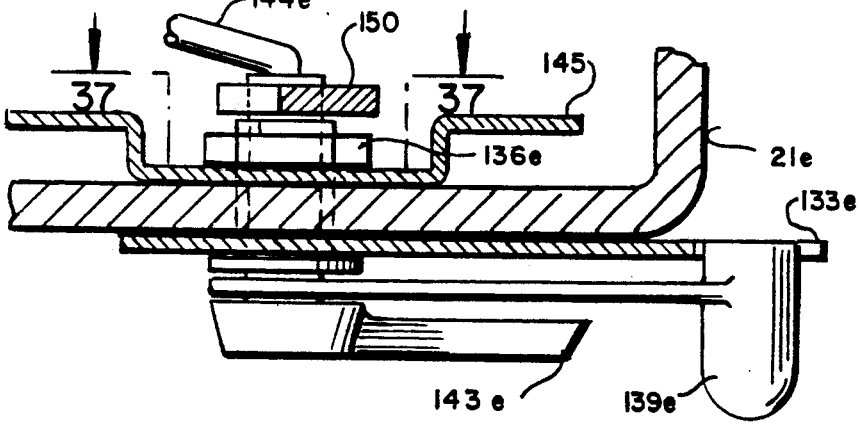
Figure 36:
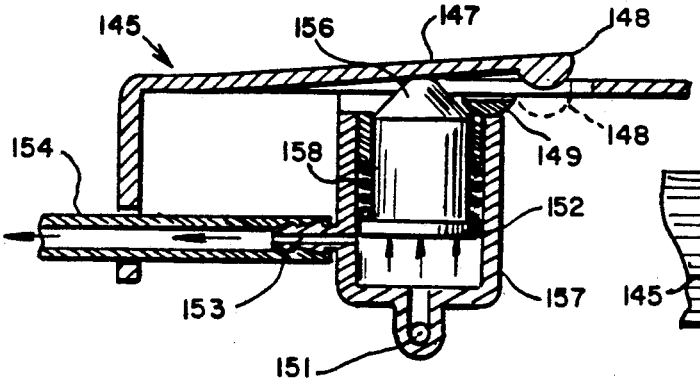

FIG. 31 is a section view as taken along line 31—31 of FIG. 30;

FIG. 32 is a top view as taken along line 32—32 of FIG. 30;

FIG. 33 is a section view as taken along line 33—33 of FIG. 32;

FIG. 34 is an elevation view of a hydraulic timing device;

FIG. 35 is a section view as taken along line 35—35 of FIG. 34;

FIG. 36 is a section view as taken along line 36—36 of FIG. 34; and

Figure 37:
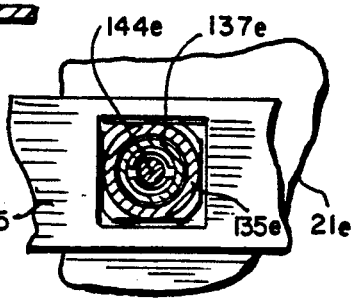

FIG. 37 is a section view as taken along line 37—37 of FIG. 35.

DESCRIPTION OF THE PREFERRED EMBODIMENT

As shown in FIGS. 1 through 8, 24, 25 and **25*a*, a first embodiment or toilet apparatus generally indicated at 4 is provided. Apparatus 4 includes a storage means 15 for storing fluid or water 16, a low volume discharge means 17, a high volume discharge means 18, and a fluid supply means 19**.

Figure 1:
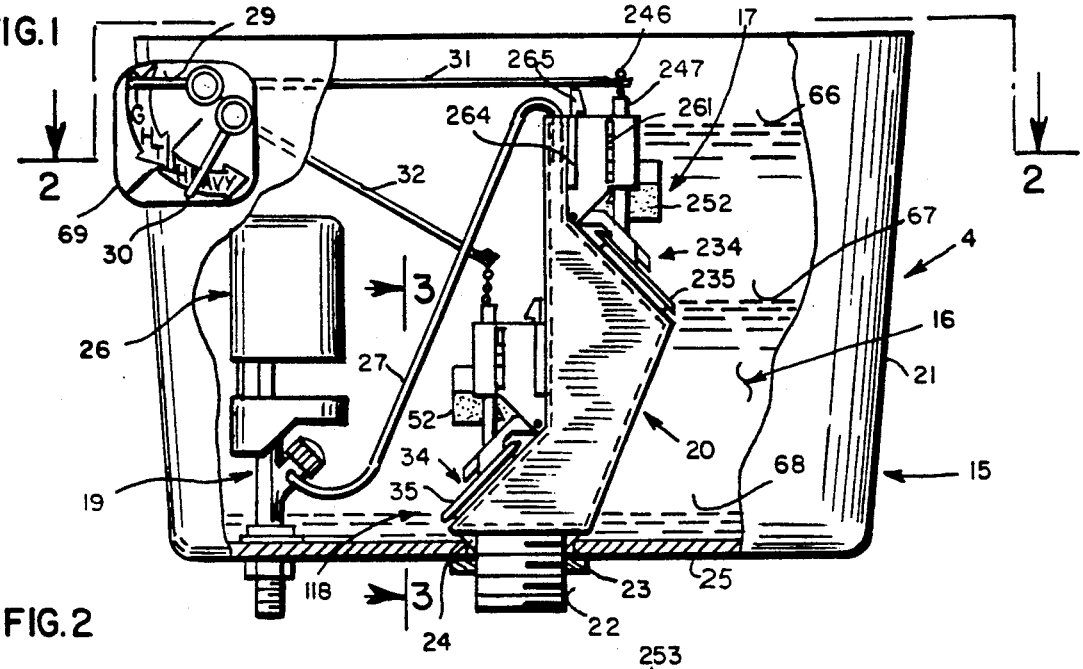
FIG. 1 is an elevation view of a toilet apparatus according to the invention.
Figure 2:
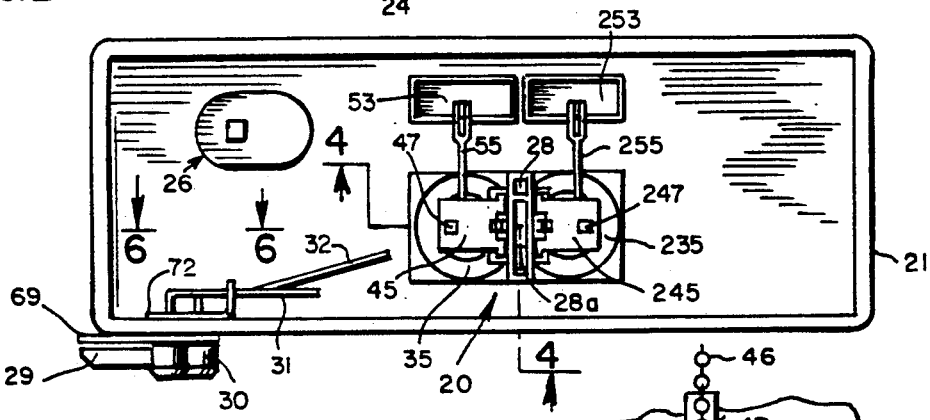
FIG. 2 is a top view as taken along line 2—2 of FIG. 1.

As shown in FIGS. 1 and 2, high volume discharge 18 has a vertical, hollow housing 20 for outflow of fluid 16. Storage means 15 has a tank 21. Housing 20 has a sleeve 22, nut 23 and seal 24, which connect housing 20 to a bottom wall 25 of tank 21. Supply means 19 has a conventional, float activated, inlet valve 26, which has a hose 27.

As shown in FIGS. 1 and 2, housing 20 has an opening 28 for hose 27 and has a larger opening **28*a* for fluid overflow. Low volume discharge means 17 has an upper handle 29 which has a rod 31. High volume discharge 18 has a lower handle 30 which has a rod 32. The parts of high volume discharge 18 are described below and the parts of low volume discharge 17 are described thereafter. Discharge means 18 has a discharge opening 33 and has a closure unit 34**.

Figure 3:
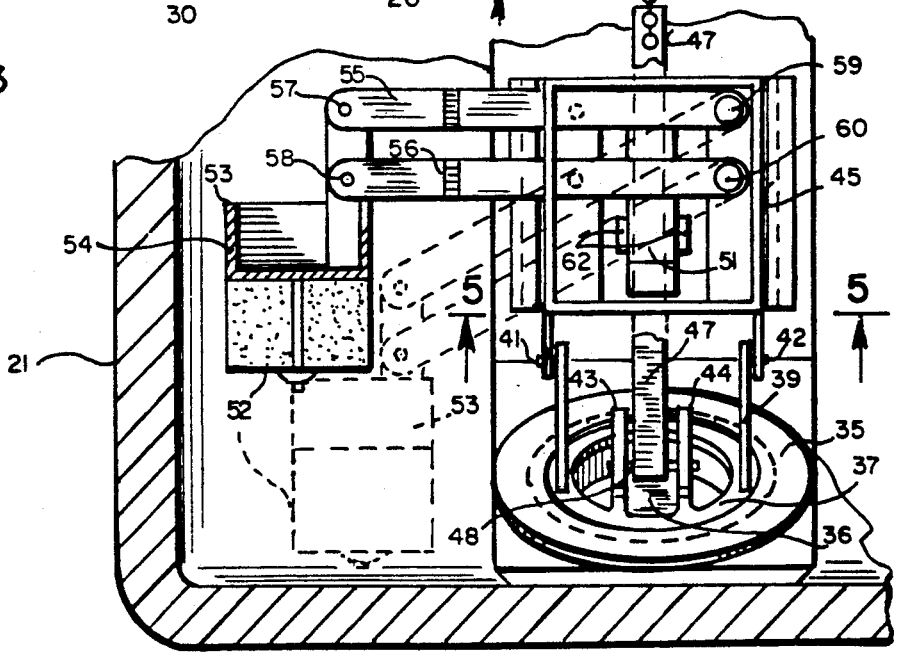
FIG. 3 is a section view as taken along line 3—3 of FIG. 1.
Figure 4:
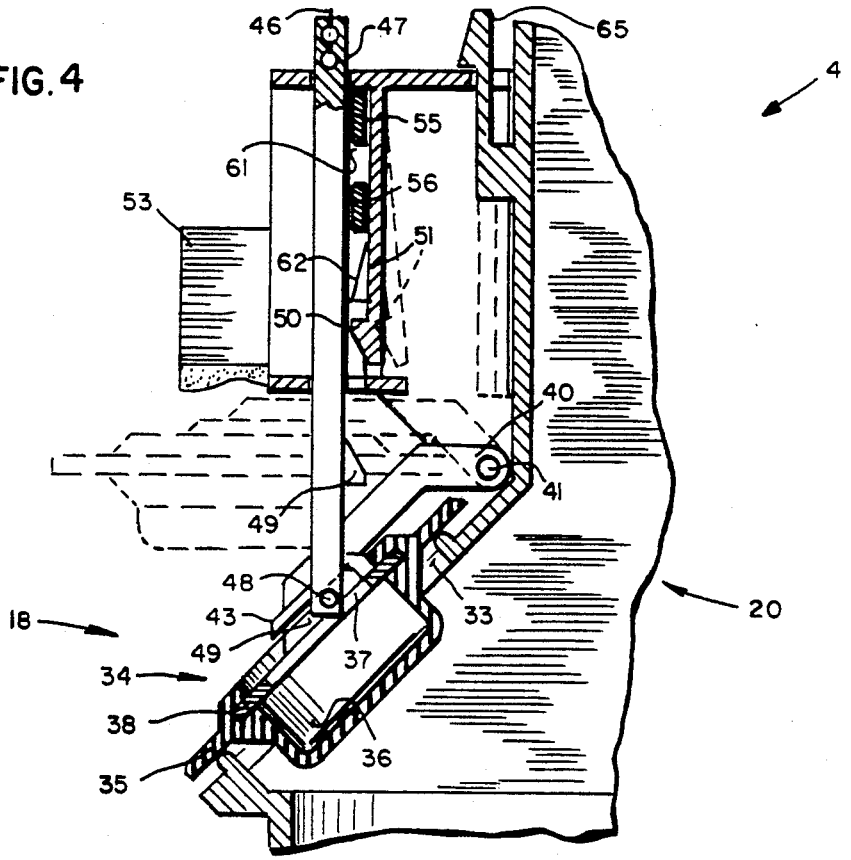
FIG. 4 is a section view as taken along line 4—4 of FIG. 2.
Figure 5:
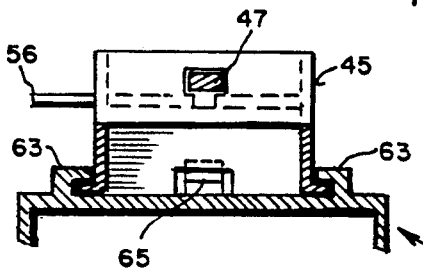
FIG. 5 is a section view as taken along line 5—5 of FIG. 3.

As shown in FIGS. 3, 4 and 5, closure unit 34 has a cup shaped cover 35 which has a cavity 36. The closure unit 4 also has a frame 37, which is retained in a slot 38 in cover 35. The frame 37 which is retained in a slot 38 in the cover 35. The frame 37 has a first extension 39 and a second extension 40. The extension 40 has a hinge pin 41, and the extension 39 has a hinge pin 42. The frame 37 also has a first extension 43 and a second extension 44. The hinge pins 41 and 42 connect to a housing 45 at the bottom thereof. The housing 45 at the top thereof has a cam rod 47, which connects to a chain 46. The cam rod 47 at the bottom end thereof connects to a pin 48, which is disposed in extensions 43,44. The frame 37 has a slot 49 disposed under the extensions 43, 44 which in operation, by turning handle 30, the bar 32 and chain 46 and rod 47 and cover 35 are lifted for heavy or high volume fluid discharge. Cover 35, is held open as explained hereafter.

Low volume discharge means 17 which is opposite hand but which has the same construction as high volume discharge means 18, includes a similar closure 234, cover 235, housing 245, chain 246 and cam rod 247.

In operation, by turning handle 29, the bar 31 chain 246, rod 247 and cover 235 are lifted for light or low volume fluid discharge. Either handle 30 or 29 can be operated.

As shown in FIGS. 3,4 and 5, housing 45 has a lock or catch 50, which is mounted on a spring 51, that is disposed behind rod 47 at the center of housing 45. The housing 45 supports a float 52 which is composed of styrofoam material or the like float 52 is supported by a vessel 53 which has a rectangular extension 54 and which has support arms 55,56. Arms 55,56 have respective pins 59,60 which connect to housing 45, Arms 55, 56 extend through a slot 61 in housing 45. A pair of cams 62 are disposed on opposite sides of spring 51. A pair of guides 63 bear against slide portion 64 of housing 45. A lock cam 65 bears against the housing 45 at the top thereof.

In operation, when the water level falls, float 52, vessel 53 and arms 55, 56 move downwardly. The weight of water in vessel 53 causes a downward force on the vessel 53. The downward movement causes arm 56 to depress the pair of cams 62 and spring 51, which causes a disengagement of catch 50 from cam 49 on rod 47. Such disengagement permits rod 47 and closure 34 to fall downwardly for closing opening 33.

For ease of maintenance, housing 45, and its assembled parts, can be removed from tank 21 by depressing cam 65 and by lifting housing 45.

Low volume discharge means 17 has a corresponding float 252, vessel 253, arm 255, slot 261, slide portion 264, and cam 265.

Fluid 16 has a full tank level 66, a sixty percent of full level 67, and a near empty level 68, in this embodiment.

Figure 6:
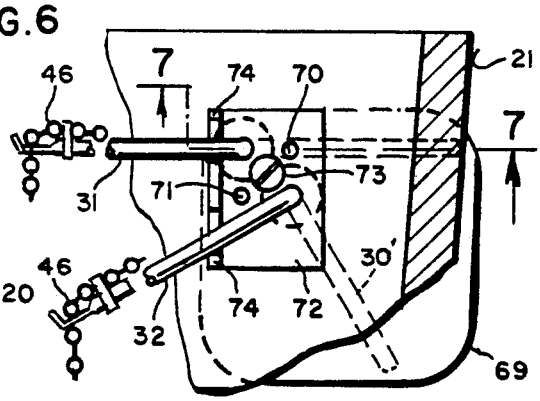
FIG. 6 is a section view as taken along line 6—6 of FIG. 2.
Figure 7:
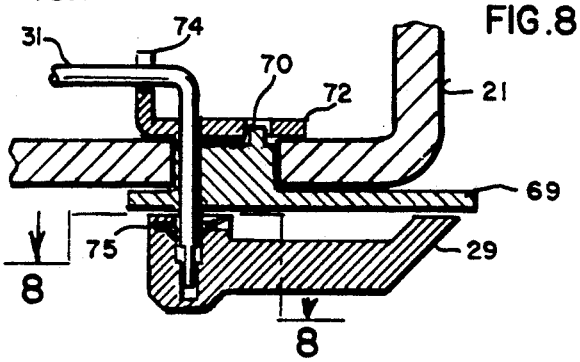
FIG. 7 is a section view as taken along line 7—7 of FIG. 6.
Figure 8:
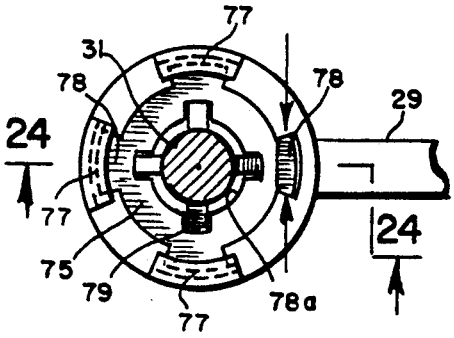
FIG. 8 is a section view as taken along line 8—8 of FIG. 7.

As shown in FIGS. 6, 7 and 8, handles 29, 30 have a plate 69 with instructions. Plate 69 has pins or extensions 70, 71 which position an inner bracket 72. Bracket 72 has a threaded fastener 73 which connects to plate 69, for assembly of bracket 72 to plate 69. Bracket 72 has stop portions 74 for limiting the angular travel of rods 31, 32.

As shown in FIGS. 8, 24, 25 and 25*a*, typical handle 29 which is identical to handle 30, has a retaining ring 75, which fits into a cylindrical opening 76. Opening 76 has undercut segments 77. Ring 75 has four protruding segments 78, three of which are received in three undercut segments 77. Ring 75 has a radially inner opening 78*a* through which rod 31 extends. Ring has spaced prongs 79 which extend into opening 78*a* and which engage rod 31. Rod 31 has a flat end portion which is received in a cooperating portion of handle 29 for transmitting turning moment from handle 29 to rod 31. Prongs 79 are bent at selective angles or pitch to form a thread-like path on rod 31. Segments 77, segments 78 and prongs 79 have a ninety degree spacing. One of the segments 78, which does not have a corresponding undercut segment opposite thereto, bears on the outer end face of handle 29. The thread-like path of prongs 79 permits easy disassembly for maintenance.

As shown in FIGS. 9 through 12, 22 and 23, a second embodiment or apparatus generally indicated at 5 is provided. Parts of this embodiment which are like parts of embodiment generally indicated at 4 have the same numerals, but with a subscript "b" added thereto. Apparatus 5 includes supply means 26*b*, first discharge means 34*b*, second discharge means or gate means 85, and storage means or tank means 80.

Tank 80 has a partition 81, which separates first compartment 82 from second compartment 83. First discharge means 34*b* has a hollow housing 84 and has a rod 32*b*.

Gate or door 85 covers an opening 86. Gate 85 is composed of molded rubber material. Gate 85 has two fasteners 87 at its upper end for connection to partition 81. Fasteners 81 connect to a bracket 88, which has an L-shape. Bracket 88 has a guide opening 89 for a cable 90. Cable 90 at one end thereof connects to gate portion 91; and cable 90 at its other end connects to handle arm 92. Handle 93, which operates handle arm 92, has a plate 94.

Figure 22:
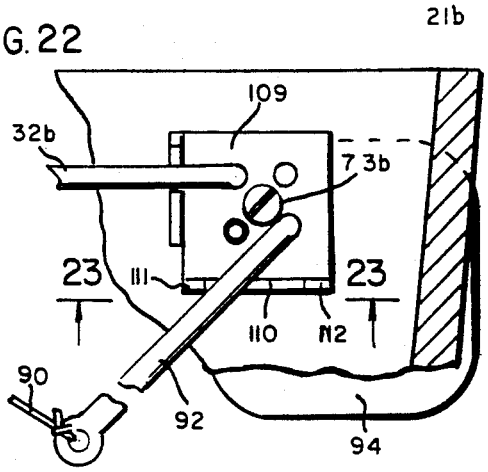
FIG. 22 is a section view as taken along line 22—22 of FIG. 10.
Figure 23:
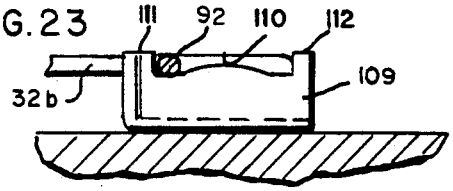
FIG. 23 is a section view as taken along line 23—23 of FIG. 22.
Figure 24:
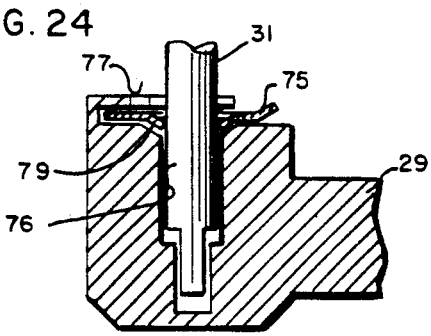
FIG. 24 is a section view as taken along line 24—24 of FIG. 8.

As shown in FIGS. 22 and 23, plate 94 has an inner bracket 109, which supports arms 32*b*, 92. Bracket 109 has an arch-shaped edge portion 110, disposed between stops 111,112. Portion 110 acts in friction against arm 92, and urges arm 92 towards a stop 111 or 112, in order to hold gate 85 in an open or closed position. Stops 111, 112 can be slightly relocated on the edge of plate 94, as required, to suit the angle of swing of arm 92.

In operation, rod 92 is first set for low volume or high volume discharge; thereafter, rod 32*b* is actuated. When tank 0 is being filled with water, supply valve 26*b* will fill both compartments 82, 83 regardless of the position of gate 85. For low volume or light discharge or flush, handle 93 is set in the L-position, so that cable 90 is not taut; and gate 85 is closed due to a pressure drop across the gate 85. For high volume discharge, handle 93 is set in the H-position, so that cable 90 is taut and gate 85 is open.

Figure 14:
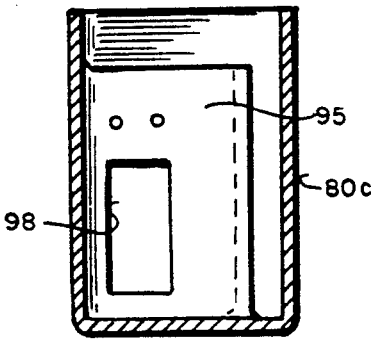
FIG. 14 is a section view as taken along line 14—14 of FIG. 13.
Figure 15:
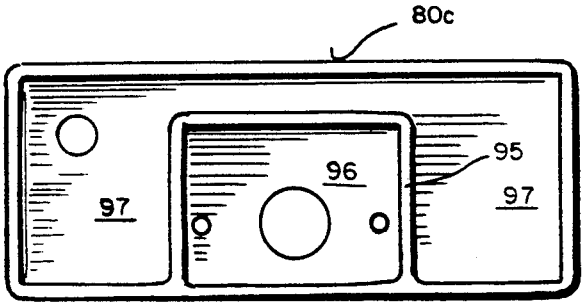
FIG. 15 is a section view as taken along line 15—15 of FIG. 13.
Figure 16:
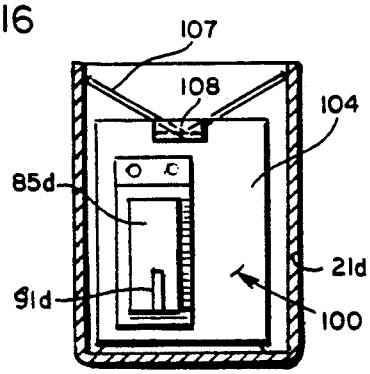
FIG. 16 is a section view as taken along line 16—16 of FIG. 17.

As shown in FIGS. 13, 14 and 15, a third embodiment or apparatus generally indicated at 6 is provided. This apparatus is similar to apparatus generally indicated at 5; and most of the identical parts are omitted for ease of illustration. The parts, which are shown and which are the same as the corresponding parts of embodiment 5, have the same numerals, but with a subscript "c" added thereto.

In operation, during a low volume or light discharge or flush an additional water volume will be discharged. Such additional water volume will pass from compartment 97 and through openings 99 into compartment 96 for discharge.

As shown in FIGS. 16 through 21, a fourth embodiment or apparatus generally indicated at 7 is provided. Apparatus 7 is similar to embodiments 4, 5 and 6. Similar parts of this embodiment 7 have the same numerals as corresponding parts of embodiments 4,5 and 6, but with a subscript "d" added thereto.

Figure 21:
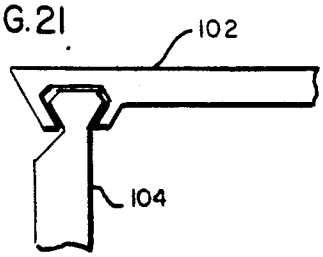
FIG. 21 is a section view as taken along line 21—21 of FIG. 17.

Apparatus 7 has a tank 21*d* and a gate 85*d*, which has a portion 91*d*. Tank 22*d* has a panel assembly 100. Assembly 100 has a lower sealing edge 101, as shown in FIG. 21.

Assembly 100 has a back panel 102, which has a plurality of holes 103. Assembly 100 has a side panel 104, which has a gate opening 105 that is covered by a door 85*d*. Tank 21*d* has a bottom wall 106, which supports assembly 100. Assembly 100 has v-shaped, spring-type braces 107 at each end thereof for bracing assembly 100. Braces 107 are received in respective U-shaped holder portions 108 of assembly 100 at each end thereof. Braces 107, each, have sharp ends which engage the front and back walls of tank 21*d*.

Figure 9:
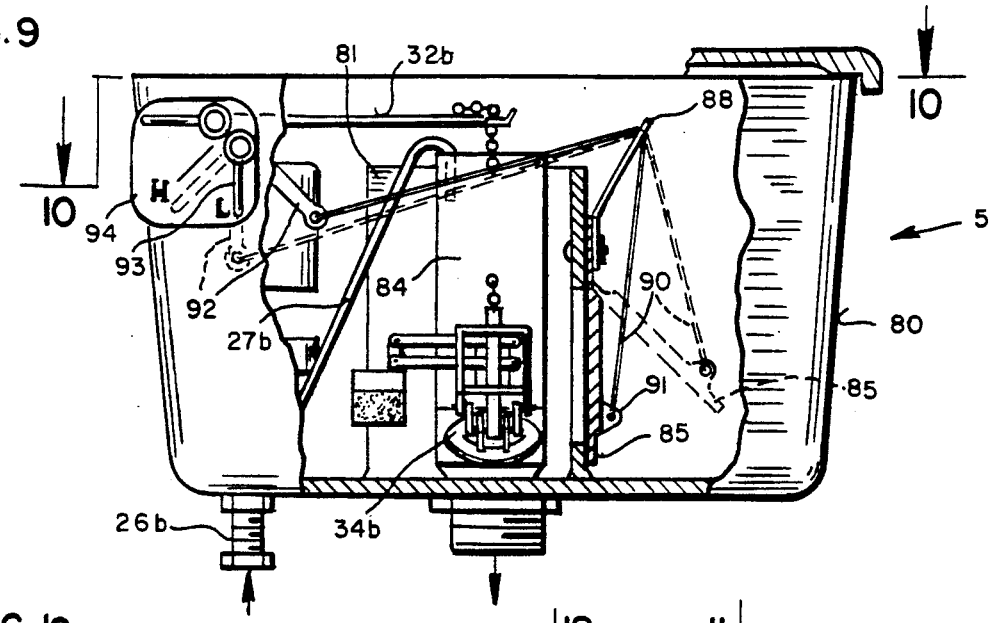
FIG. 9 is an elevation view which shows a second embodiment of the invention.
Figure 10:
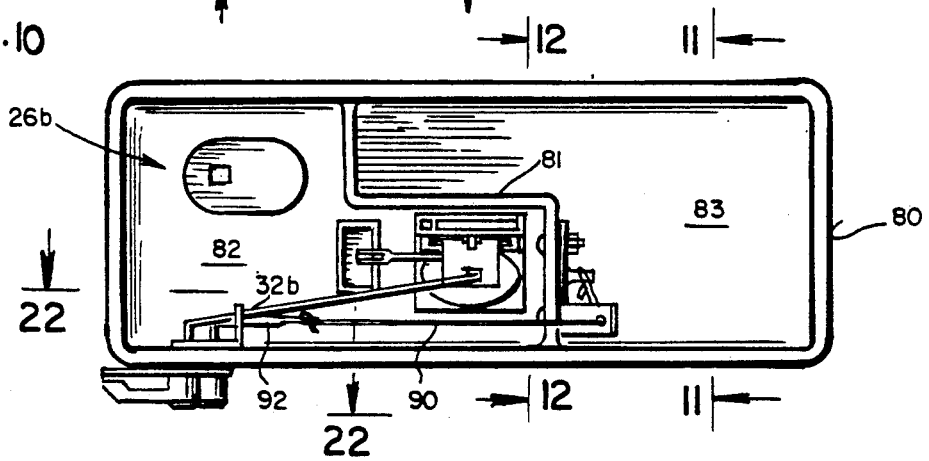
FIG. 10 is a top view as taken along line 10—10 of FIG. 9.
Figure 11:
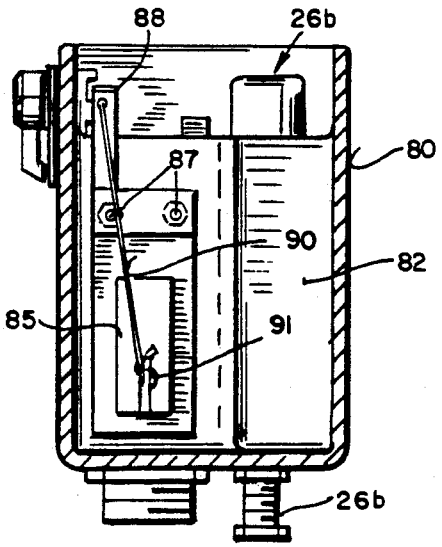
FIG. 11 is a section view as taken along line 11—11 of FIG. 10.
Figure 12:
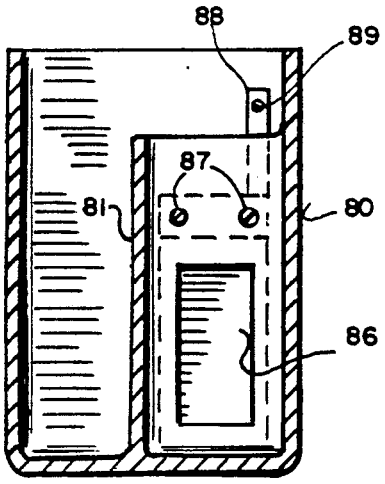
FIG. 12 is a section view as taken along line 12—12 of FIG. 10.

Tank 21*d* has a supply valve (not shown), like valve 34*b* of FIG. 9. Gate door 85*d* has a cable 115, which connects to a handle 116, that has a clip or bracket 117.

In operation, door 85*d* is positioned by handle 116, in an open or closed position, as desired. Then, the discharge valve (not shown) is actuated.

One advantage of this embodiment 7 is that panel assembly 100 with handle 116, as a subassembly, can be a separate kit, for use in a modification of a prior art toilet apparatus.

Figure 17:
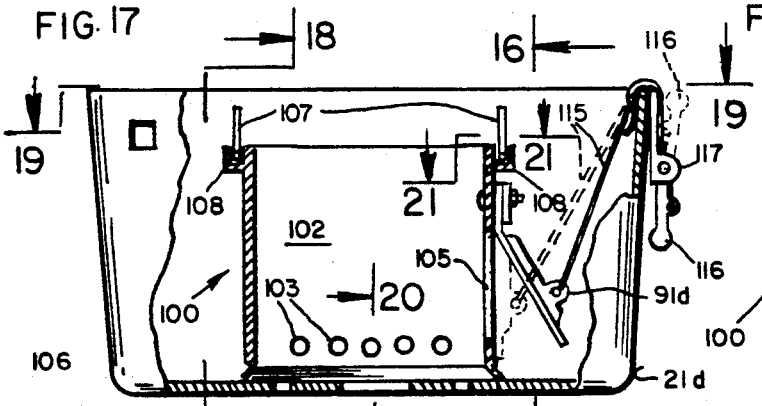
FIG. 17 is an elevation view of a fourth embodiment of the invention.
Figure 18:
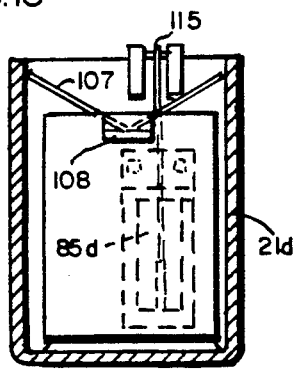
FIG. 18 is a section view as taken along line 18—18 of FIG. 17.
Figure 19:
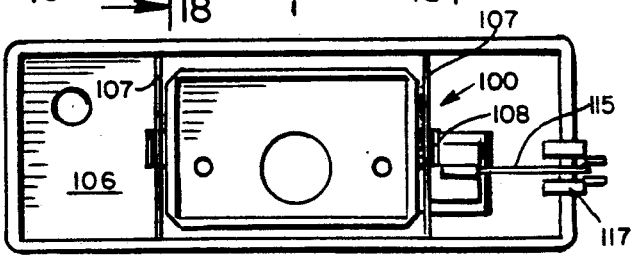
FIG. 19 is a section view as taken along line 19—19 of FIG. 17.
Figure 20:
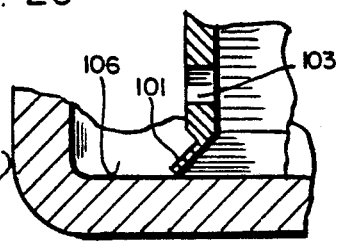
FIG. 20 is a section view as taken along line 20—20 of FIG. 17.

As shown in FIGS. 26, 27, 28 and 29, another type of discharge valve assembly 113, for the tank of FIG. 13, or the tank of FIG. 17, is provided. Valve 113 has a closing subassembly 114. Subassembly 114 has a clamp 118, which is mounted on an overfill tube 119. Clamp 118 has a pivot pin 120. Subassembly 114 also has a hinge pin 121. Pivot pin 120 supports a bearing arm 122, which supports a container 123. Valve assembly 113 also has a bracket 124 which is supported by a plug member 125 that is actuated by a lift chain 126. Bracket 124 has a slot 127 with an oversize hole 128 at one end thereof, for a connection of chain 126 to plug member 125, and for connection of chain 126 to bracket 124. Container 123 has a small hole 129, which is located in a bottom wall 130 thereof.

Bracket 124 has a stop portion 131, which contacts tube 119 in a fully open position of bracket 124 and plug member 125.

In operation, as water is discharged from the tank by valve 113, the water level drops, and the water in container 123 empties out of container 123 through hole 129, thereby causing cylinder 123 to rotate and to urge plug member 125 to its fully closed position.

As shown in FIGS. 30, 31, 32 and 33, a handle subassembly, for the tank of FIG. 13 is provided. Tank 21*c* supports a plate 132, which has a heavy or a high (H) stop portion 133, and which has a heavy or a low (L) stop portion 134. Plate 132 has an outer flange sleeve 135, which extends through plate 132, and which has a nut 136 at the inside end thereof. Sleeve 135 has an inner hollow shaft 137, which extends therethrough. Hollow shaft 137 has an outside arm 138, which has a knob 139 for angularly displacing arm 138, which has a knob 139 for angularly displacing arm 138 and hollow shaft 137. Hollow shaft 137 has a round disk or Belleville Spring 140, which is disposed next to nut 136. Hollow shaft 137 has an inside arm 141 which is fixedly connected thereto by a fastener or set screw 142. Inside area 141 connects to the door chain (Not shown). A handle 143, which has a bent rod 144, that is fixedly connected thereto, extends through inner hollow shaft 137. Bent rod 144 connects to the valve chain (not shown).

As shown in FIGS. 34, 35, 36, 37, another handle assembly is provided. This handle assembly is similar to the handle assembly of FIG. 30. Parts of this assembly which are similar to the parts of the assembly of FIG. 30 have the same numerals but with a subscript "e" added thereto.

Tank 21*e* supports an outside plate 132*e*, which has a high or heavy H-stop 133*e* and has a low or light l-stop 134*e*. Plate 132*c* has a sleeve 135*e*, which has a square cross-section at one end thereof, that fits into a square hole in tank 21*e*. Sleeve 135*e* has an inner hollow shaft 137*e*, which is fixedly connected to an outside arm 138*e*, that has a knob 139*e*. A handle 143*e*, which has a bent rod 144*e* extends through inner hollow shaft 137*e*. Rod 144*e* connects to a valve (not shown).

Plate 145 has a U-shaped cutout 146, which forms a leaf spring 147, that has a cam 148. When knob 139*e* is positioned at the H-stop 133*e*, a round end 149 of inside arm 150 is locked in position by cam 148. Knob 139*e* connects to outside arm 138*e*, which connects to inside arm 150, that connects to a gate door (not shown).

Inside arm 150 is locked in position when outside arm 138*e* is moved to the H-stop 133*e* by the latch means or latch spring or leaf spring 147. Spring 147 is released by a release means or piston 152, after the water is discharged from tank 21*e*. Piston 152 is disposed in a cylinder 157, which has an inlet 151 and an outlet 153. An overflow tube 27*e* from a conventional supply valve (not shown) connects to inlet 151. Piston 152 is urged by fluid pressure to force its piston end portion 156 against leaf spring 147, thereby releasing inside arm 150. A piston compression spring 158 urges piston head 156 away from leaf spring 147, after inside arm 150 is released, when the water pressure drops. Water passes through outlet 153 and tube 154 to an overflow tube (not shown).

Inside arm 150 has an elongate tension spring 155. Inside arm 150 has a post 159 fixedly connected thereto. Post 159 connects to a cable 161, which extends through spring 155 and a plate projection 160. Cable 161 has a connector ring 162 which connects to a gate door chain (not shown). Cable 161 and arm 150 are urged by elongate tension spring 155 towards the L-position.

The advantages of apparatus 10 and its embodiments are indicated hereafter.

A) The problem of not being able to conserve water, used by prior art toilet apparatus, is overcome.

B) The problem of not being able to modify a prior art toilet apparatus, so as to conserve water, is overcome.

C) A toilet apparatus having an improved toilet tank is provided.

D) An apparatus having an improved handle assembly is provided.

E) An apparatus having an improved water discharge valve is provided.

F) An apparatus having a handle assembly with an improved release subassembly is provided.

While the invention has been described in its preferred embodiment, it is to be understood that the words which have been used are words of description rather than limitation and that changes may be made within the purview of the appended claims without departing from the true scope and spirit of the invention it its broader aspects.

What is claimed is:

1. A toilet apparatus comprising: storage means for storing a volume of fluid; fluid supply means for supplying the fluid; low volume discharge means for discharging a relatively low volume of the fluid; and high volume discharge means for discharging a relatively high volume of the fluid, wherein said storage means includes a toilet tank for water; said toilet tank having a plurality of walls; said plurality of walls including a partition wall separating a first compartment from a second compartment, said partition wall having a gate opening with a gate door; said high volume discharge means includes a discharge valve which extends through and sealingly engages a wall of the tank in the first compartment and further includes the gate door in its open position for flow from both compartment; said low volume discharge means includes said discharge valve and further includes the gate door in its closed position for flow from the first compartment only, including a handle subassembly having an outside plate with instruction marking; said handle subassembly having a first valve discharge handle for actuating the discharge valve; said handle subassembly having a second gate door discharge handle for actuating the gate door; said outside plate having a sleeve extending through a front wall of the tank; said gate door handle having a hollow shaft extending through the sleeve; said discharge valve handle having a rod extending through the hollow shaft and wherein said gate door handle hollow shaft has an inside arm for connection to a gate door chain-like member; said tank front wall has an inside plate having a leaf spring for locking the inside arm when in a high volume position with the gate door open; said inside plate has a release means for actuating the leaf spring in order to unlock the inside arm for movement of the inside arm to a low volume position with the gate door closed; said release means including a cylinder having a piston movable relative thereto; said piston having an end portion for actuating the leaf spring; said cylinder having a chamber with an inlet for connection to a supply valve overflow tube and with an outlet for connection to an overflow outlet whereby the piston actuates the leaf spring and releases the inside arm from its high volume position after water discharges from the tank first compartment.

2. A toilet apparatus comprising: a toilet tank for water; a fluid supply valve; a discharge means having a handle subassembly to operate either a low volume discharge or a high volume discharge; said toilet tank having a plurality of walls including an intermediate wall or partition wall forming a first compartment for discharge of water therefrom and a second compartment for storage of water; said discharge means including a first discharge gate and a second discharge gate; said first discharge gate being disposed so as to control a volume of water; and said second discharge gate being disposed so as to control a volume of water, wherein said discharge means includes for the high volume discharge a chain-like member, and a handle having a portion fixedly connected to a rod; and said discharge means for the low volume discharge includes a second chain-like member connected to the low volume discharge valve, a second rod connected to said second chain-like member, and a second handle having a portion fixedly connected to said second rod, wherein said partition wall is characterized by a gate opening and a gate door therefor, said high volume discharge means including a discharge valve which extends through and sealingly engages a wall of the tank in the first compartment and further including the gate door in its open position for flow from both said compartments; and said low volume discharge means including said discharge valve and further including the gate door in its closed position for flow from the first compartment only, wherein said discharge valve comprises a plug member rotatable through an angle between an open position and a closed position; said plug member having a cam member hinged thereto; said cam member having a lock means having a release means for unlocking the cam member for placing the plug member in the closed position after fluid discharge.

3. The apparatus of claim 2, wherein said lock means includes a leaf spring having a catch for locking the cam member in the open position during fluid discharge; and said release means includes a release bar having a portion which displaces the leaf spring for unlocking the cam member after fluid discharge for movement of the plug member to the closed position.

4. The apparatus of claim 3, wherein said release bar has a hinged portion at one end thereof and has a float with a vessel at the other end thereof; said float providing an upward force on the release bar for disengagement of the release bar from the leaf spring when locked during fluid discharge; and said vessel providing a downward force from contained fluid on the release bar for engagement of the release bar with the leaf spring after tank fluid discharge for unlocking the leaf spring.

* * * * *